United States Patent [19]

Fray et al.

[11] 4,118,292

[45] Oct. 3, 1978

[54] PACKED BED ELECTROREFINING AND ELECTROLYSIS

[75] Inventors: Derek John Fray, Trumpington; James Henry Cleland, Cambridge, both of England

[73] Assignee: National Research Development Corporation, London, England

[21] Appl. No.: 804,807

[22] Filed: Jun. 8, 1977

[30] Foreign Application Priority Data

Jun. 9, 1976 [GB] United Kingdom ..... 23894/76
Nov. 5, 1976 [GB] United Kingdom ..... 46171/76

[51] Int. Cl.[2] ..... C25C 3/00; C25C 3/34; C25C 3/06

[52] U.S. Cl. ..... 204/67; 204/64 R; 204/64 T; 204/66

[58] Field of Search ..... 204/67, 64–70

[56] References Cited

U.S. PATENT DOCUMENTS

| | | | |
|---|---|---|---|
| 1,384,499 | 7/1921 | Tucker | 204/67 |
| 3,553,092 | 12/1966 | Mund et al. | 204/180 |
| 3,798,140 | 3/1974 | Sullivan et al. | 204/67 |

*Primary Examiner*—Howard S. Williams
*Attorney, Agent, or Firm*—Cushman, Darby & Cushman

[57] ABSTRACT

A molten metal, such as aluminium, is refined by passing a stream thereof into an anode comprising a bed of conductive particles, such as carbon, in a molten or conductive-solution salt. A diaphragm, pervious to the salt but impervious to the molten metal, separates the anode from a cathode comprising a bed of conductive particles in a salt which is molten or in conductive solution.

9 Claims, 1 Drawing Figure

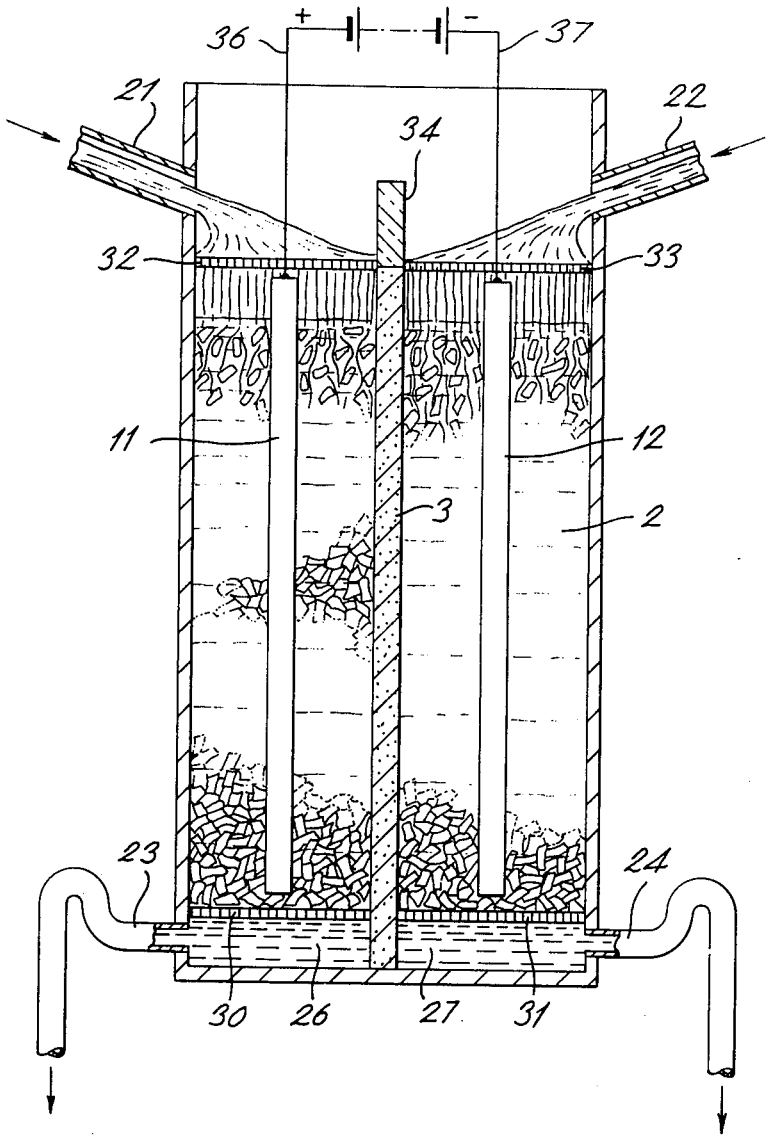
36
37
+
-
21
22
34
32
33
11
12
3
2
23
24
30
26
27
31

PACKED BED ELECTROREFINING AND ELECTROLYSIS

This invention relates to a packed bed method of electrorefining a molten metal, or of electrolysis of a salt to obtain a metal, and to a cell for performing the method.

According to the invention, a molten metal is refined by passing a stream thereof (optionally through a distributor) into an anode comprising a bed of conductive particles in a salt which is molten or in a conductive solution, the anode being separated by a diaphragm, pervious to the salt but impervious to the molten metal, from a cathode comprising a bed of conductive particles in a salt which is molten or in a conductive solution. The conductive solution may be aqueous. Through the cathode there may be passed a stream of molten metal purer than that passed through the anode. It should be understood that the invention cannot remove contaminant metals which are more noble than the metal to be refined.

The distributor (when present) is intended to spread the stream over substantially the whole area (as seen in plan) of the bed.

Further according to the invention, a salt is electrolysed to obtain a metal by passing a stream of the salt, which is molten or in a conductive solution, (optionally through a distributor) into a cell having an anode comprising a bed of conductive particles in a diluent which is molten or in a conductive solution, the anode being separated by a diaphragm pervious to the salts from a cathode comprising a bed of conductive particles in a salt which is molten or in a conductive solution. The distributor (when present) is intended to spread the stream over substantially the whole area (as seen in plan) of the bed.

Also according to the invention, a cell comprises an anode compartment containing a bed of conductive particles in a salt which is molten or in a conductive solution, means for passing a stream of molten metal or molten salt or salt in a conductive solution into the bed, a diaphragm of which one side (at least in part) bounds the anode compartment, a cathode compartment containing a bed of conductive particles in a salt which is molten or in a conductive solution on the other side of the diaphragm, which is pervious to the salt(s) but not to the molten metal. The cathode compartment may have means for passing a stream of molten metal through the bed. The anode compartment may have means for recirculating the liquid passed into and throught it.

The diaphragm is saturated with the salt and, although preventing mixing of molten metal from opposite sides thereof, does allow metal ions to move through freely. The conductive particles may for example be granules of carbon or of titanium diboride; even metal particles can be used if unattacked by the salt(s) or the metal being refined and its contaminant(s). The salt is preferably a halide, (usually these are cheaper), e.g. zinc chloride or aluminium chloride, either possibly including as impurities or diluents up to 95% of sodium chloride and/or potassium chloride and/or lithium chloride. The salt advantageously is or includes a salt of the metal to be refined. Although the salt at the anode most conveniently has the same composition as that at the cathode, this is not essential. The metal may be zinc including as impurities for example aluminium, lead, cadmium, copper, tin and/or iron. Such a combination of impurities may arise when recovering zinc from scrap diecastings. The metal may alternatively be aluminium, which may include as impurities such metals as zinc, tin, lead, copper and/or gold.

The cell may further comprise a distributor between the means for passing the stream and the bed of the anode compartment. Where the cathode compartment has means for passing a stream, here too a distributor may be provided between these means and the bed of the cathode compartment. Preferably a separator is provided upstream of the distributor(s) as a barrier to mixing between the "anode" and "cathode" streams; this separator may be a plate which is generally in line with the diaphragm.

In the case of electrolysing a salt, the salt may be a halide, for example aluminium chloride, aluminium being evolved on the conductive particles of the cathode. This process would normally be performed above the melting point of aluminium.

The invention will now be described by way of example with reference to the accompanying drawing, which is a diagrammatic elevation of a cell according to the invention. For illustration, it will be supposed that a metal is to be refined, namely zinc.

In the FIGURE, a cell has an anode compartment 1 and a cathode compartment 2 separated by a diaphragm 3 pervious to $Zn^{++}$ ions but not to molten zinc. The diaphragm 3 is a fibrous ceramic fabric consisting of aluminosilicate or silica fibres felted or spun and woven to form a material e.g. Fiberfrax PH (Carborundum Co.) or Triton Kaowool (available from Morganite) in half-inch or 1-inch thickness, or Refrasil (Chemical And Insulating Co. Ltd of Darlington (Darchem Group)) one-tenth of an inch thick. The diaphragm is normally an insulator but when saturated with electrolyte (as will be described) can transport current in the form of $Zn^{++}$ ions. The thinner diaphragms are preferred because of their lower resistive losses in service, but care should be taken to prevent their failing mechanically. The diaphragm receives mechanical support on each side from a bed of particles (described below) and is flexible, thus being able to absorb local strains resulting from temporary hydrostatic electrolyte pressure differences on each side. The diaphragm is accordingly quite resistant to puncturing, which would cause short-circuiting.

The compartments 1 and 2 are both evenly packed with a bed of conductive particles resting on a respective perforated glass plate 30, 31. These particles may be of titanium boride with a diameter of 4mm, or may be of carbon in any of several shapes and sizes e.g. spheres of 9mm diameter (Morganite Carbon Spheres EY9), crushed electrodes in particles 6 to 8 mm across, animal charcoal (4–7 mm particles), and rings and saddles (both 6mm long and 12mm in diameter). Depending on the purpose, the carbon spheres or saddles are preferred. The particles will occupy the bed at a packing efficiency (actual volume of the particles / volume of the bed comprised by the particles) which depends on the shapes of the particles and is usually of from 20% to 90%; in specific cases packing efficiences of 42% and 70% have proved advantageous. The looser packing shown in a part of the FIGURE is for clarity only.

Above the beds of particles in the compartments 1 and 2 there are provided distributors in the form of respective spreader plates 32, 33, which are (but need not be) identical to the perforated glass support plates 30, 31. The compartments 1 and 2 have, above the spreader plates 32, 33, respective inlets 21 and 22 for molten metal.

The packed compartments 1 and 2 are filled with a molten electrolyte consisting of 66% by weight $ZnCl_2$ + 34% NaCl. This electrolyte also saturates the diaphragm 3. The compartments 1 and 2 have below the plates 30 and 31, respective outlets 23 and 24 for molten metal. The regions 26 and 27 below the plates form sumps for molten metal. The outlets 23 and 24 are so arranged with back-pressure-generating turns that the level of molten metal in the compartments 1 and 2 never falls below the plates 30, 31.

In use, the molten metal to be refined (i.e., zinc plus impurities) is continuously passed from the inlet 21 to the outlet 23, forming (it is thought) rivulets throught the less dense molten electrolyte on their way covering the enormous surface area offered by the bed in the anode compartment 1 and falling into the sump 26, displacing the less dense molten electrolyte therefrom. Meanwhile, pure molten metal (i.e., pure zinc) is continuously passed from the inlet 22 to the outlet 24, likewise covering the surface area offered by the bed in the cathode compartment 2. Circulation of the molten metal in this way is the only practical way of ensuring constant mixing.

The support plates 30, 31 are perforated so as to retain the conductive particles while allowing molten metal to drain out. The spreader plates 32, 33 are also perforated, but for a different reason, which is to break up streams of metal issuing from the inlets 21, 22 into trickles of metal reasonably well distributed over more or less the whole width (i.e., over the whole area as seen in plan) of the respective beds. Accordingly, the perforations in the spreader plates 32, 33 can be finer or coarser than those in the support plates 30, 31.

To prevent mixing between streams of metal issuing from the inlets 21 and 22, the space between them is divided by a separator in the form of a glass partition 34 which is geometrically speaking an upwards continuation of the diaphragm 3 and, also like the diaphragm 3, forms a barier to the intermixing of molten metal.

The electrodes 11, 12 are powered through braided leads 36, 37, which are enclosed in protective heat-resisting glass tubes and which are secured to the electrodes by any convenient means, such as screws.

The tubes encasing the leads 36, 37 may pass through the cell outer wall or, as shown in the FIGURE, through the spreader plate. Any arrangement will do as long as the hole which must exist for the tube to traverse is adequately sealed.

The electrodes themselves, although shown to be centrally placed within their respective packed beds, can advantageously be placed elsewhere in the packed beds, for example much further from the diaphragm 3.

The electrodes 11, 12 are preferably of carbon and may be about 230 mm high and of a diameter (being either circular or semicircular in cross-section of 6mm of 12 mm, the cell having an internal diameter of 65 mm and the diaphragm 3 having an area of 63 $cm^2$.

One or both electrodes are preferably, however, of a shape affording a larger surface area than the cylindrical electrodes just described and preferably are of at least 50% (more preferably at least 80%) of the diaphragm surface area. This can significantly lower the internal resistance of the cell. The exact shape of the electrodes is a matter of manufacturing convenience, and may for example be a flat rectangle parallel to the diaphragm.

The diaphragm 3 may be of 'Saffil' (trade mark), available from I.C.I. and made of inorganic fibres thought to be of zirconia or aluminia. As a potential difference is applied externally between the electrodes 11 and 12, postively charged ions are formed in the anode compartment 1 by the reaction $$Zn \text{ (molten metal)} \rightarrow Zn^{++} + 2e.$$

These zinc ions pass into the molten electrolyte, and, under the influence of the potential difference, they migrate through the diaphragm 3 into the cathode compartment 2, where there takes place, at the electrolyte/-pure metal interface, the reaction.

$$Zn^{++} + 2e \rightarrow Zn \text{ (metal)}.$$

These freshly formed zinc atoms are simply taken up in and (thus effectively augment) the pure molten zinc. The pure zinc is returned from the outlet 24 (after the yielded zinc is removed) to the inlet 22 by a nitrogen lift pump or any other suitable means, and similarly for the anode side. The diaphragm 3 bars the intermixing of molten metals between the anode and cathode compartments 1 and 2.

Where several types of positively charged ion could arise, the potential difference need not exceed that which will create only one. Thus, when separating for example gold and caesium, the caesium will always anodically dissolve in preference to the gold. Hence, the caesium is 'refined' by the present process, thus leaving behind the gold as the 'impurity' whereby to increase its concentration in the anode compartment to any desired level. Likewise, the potential difference should be for convenience be lower than that which will decompose the electrolyte, but in certain circumstances a higher potential difference may be advantageous.

This arrangement of apparatus permits some reconciliation of the following formerly conflicting requirements in an electrorefining cell: short constant anode-cathode path (for low resistance and hence low power consumption); mixing and low current density (to avoid localised anodic depletions at the electrolyte/metal interface of the metal being refined); high current throughput (for high productivity); and small voltage drop in the electrolyte. The tall thin compartments 1 and 2 help to ensure a good premixing length and small anode-cathode path, the packed beds ensure, in effect, a large electrode surface area (hence low current density despite large current) and the circulation of the metal ensures the mixing. The cathode is also a packed bed; otherwise, we have found, the high current density thereat would cause a fog or dispersion to be be formed of the metal which we want to extract in a bulk state.

Other examples of metals which can be refined according to the invention include aluminium containing copper as an impurity, and manganese containing aluminium as an impurity.

EXAMPLE

It is frequently desired to remove lead as an impurity from zinc. An alloy comprising 2% zinc (by weight) and 98% lead (i.e., overwhelmingly impure) was refined as follows:

A cell as described above was set up, with both compartments packed with the carbon saddles mentioned above. The saddles had a bulk density of 1.21 $gcm^{-3}$ and a packing efficiency of 70% and offered a surface area of about $6mm^2$ per $mm^3$.

The molten alloy, at a temperature of 350° C, was poured through the packed bed of the saddles in the anode compartment at a rate of 525 g $sec^{-1}$. (Had the temperature been higher, eg. 450° C, pure molten zinc would have been circulated through the packed bed in the cathode compartment at a (not critical) rate conveniently about the same as the anode-compartment rate.) Since, optionally, pure molten zinc need not be circulated in this case it was not circulated and pure zinc deposited as a solid on the carbon saddles in the cathode compartment; in this case, however, the saddles had eventually to be heated to 450° C or so to recover the yielded zinc.

A potential difference of ¼ volt was applied between the electrodes and the process allowed to run for 80 minutes. The anode current density, calculated from the area of the diaphragm, was 340A $m^{-2}$. The zinc transferred during this run was found to contain 0.013 parts per million (by weight) of lead; this compares with its initial lead content of 980,000 parts per million, and is considered a reasonable separation. Other experiments show that higher temperatures (up to 450° C) and higher voltages (2v; current density 3400A $m^{-2}$) may be used; in such a case the impurity level may rise to 0.13 percent, which may be acceptable in some circumstances, especially as it is accompanied by a higher rate of production. The electrical energy consumed per pound-avoirdupois of refined zinc was 0.10 kWh, but would have been 0.84 kWh at the higher temperature and voltage. These figures neglect the power consumption of the nitrogen lift pump and of the heating elements provided to keep the electrolyte molten, but as most of the energy put into the cell is dissipated as heat, these heating elements should be in use but rarely. Moreover, the nitrogen lift pump for recirculation can be dispensed with if it is constructionally possible to provide a tall enough cell to give the required yield in one "pass" of the impure metal.

The cell can be used for refining a metal according to the invention also for example as follows:

The metal to be purified is bismuth, which contains as impurities 2% lead and 1.84% zinc. The process can be considered alternatively as refining lead and zinc from the contaminant bismuth. A molten stream of this impure bismuth is passed into the anode compartment, which contains a molten salt composition consisting of 56.6% $ZnCl_2$, 13.4% $PbCl_2$, and 30% NaCl. By operation of the cell, lead and zinc are preferentially transported to the cathode (which also contains the above molten salt composition), and no detectable bismuth was found in the cathode.

So strongly are transport of lead and zinc favoured that the molten metal issuing from the base of the anode compartment is bismuth containing only 0.19% lead and 0.02% zinc. Purified bismuth is thus recovered issuing from the anode compartment, directly in metallic form.

We claim:

1. A method of refining a molten metal comprising the steps of:

providing an anode assembly comprising a bed of conductive particles in a salt which is in a molten condition, separating the anode assembly from a cathode assembly by a diaphragm pervious to the salt and impervious to the molten metal, providing the cathode assembly, which comprises a bed of conductive particles in a salt which is in a molten condition, passing a stream of the molten metal to be refined into the anode assembly, applying a voltage between the bed of the anode assembly and the bed of the cathode assembly, and withdrawing refined molten metal from a sump region of the cathode assembly.

2. The method according to claim 1, wherein the stream of the molten metal is passed through a distributor into the anode assembly.

3. The method according to claim 1, further comprising passing, through the cathode assembly, a stream of metal purer than that passed through the anode assembly.

4. The method according to claim 1, wherein at least one salt is a halide.

5. The method according to claim 1, wherein at least one salt comprises a salt of the metal being refined.

6. The method according to claim 1, wherein the metal being refined is zinc or aluminium.

7. The method according to claim 1, wherein the salt being electrolysed is aluminium chloride.

8. The method according to claim 1, wherein the salt being electrolysed includes a diluent up to 95% of sodium chloride, potassium chloride, lithium chloride or mixtures thereof.

9. The method according to claim 1, wherein the conductive particles are of the order of millimeters in size.

* * * * *